US008302226B2

(12) United States Patent
Hu et al.

(10) Patent No.: US 8,302,226 B2
(45) Date of Patent: Nov. 6, 2012

(54) NEGATIVE PRESSURE CARE BED

(76) Inventors: Fengbin Hu, Jinan (CN); Jintao Zhu, Wenzhou (CN)

( * ) Notice: Subject to any disclaimer, the term of this patent is extended or adjusted under 35 U.S.C. 154(b) by 237 days.

(21) Appl. No.: 12/869,787

(22) Filed: Aug. 27, 2010

(65) Prior Publication Data

US 2010/0319129 A1 Dec. 23, 2010

Related U.S. Application Data

(63) Continuation of application No. PCT/CN2008/001151, filed on Jun. 16, 2008.

(30) Foreign Application Priority Data

Mar. 10, 2008 (CN) ..... 2008 1 0083912

(51) Int. Cl.
*A61G 7/02* (2006.01)

(52) U.S. Cl. ..... 5/604; 5/695; 5/605; 5/606

(58) Field of Classification Search ..... 5/604–606, 5/694, 695; 4/454, 449, 450, 479
See application file for complete search history.

(56) References Cited

U.S. PATENT DOCUMENTS 2,749,558 A * 6/1956 Lent et al. ..... 4/454
3,668,720 A * 6/1972 Wetzler ..... 5/604
4,571,759 A * 2/1986 Sasaki et al. ..... 5/604
4,631,762 A * 12/1986 Fugett ..... 5/605
5,077,845 A * 1/1992 Tokunaga et al. ..... 5/605
5,513,404 A * 5/1996 Kanai ..... 5/604
5,604,943 A * 2/1997 Kimura et al. ..... 5/604
5,729,849 A * 3/1998 Garakani ..... 5/618
7,234,178 B2 * 6/2007 Qi ..... 5/604
2003/0213065 A1 * 11/2003 Bristotti ..... 5/604
2008/0229502 A1 * 9/2008 Johnson ..... 5/604
2008/0256708 A1 * 10/2008 Park ..... 5/605
2011/0308017 A1 * 12/2011 Nakamura et al. ..... 5/605

* cited by examiner

*Primary Examiner* — William Kelleher

(74) *Attorney, Agent, or Firm* — Matthias Scholl P.C.; Matthias Scholl

(57) ABSTRACT

A negative pressure care bed, including at least a worktable, an armrest, a rocking bed having an upper bed surface and a lower bed surface, a mattress, a body including an upper part and a lower part, multiple excretion holes, a pair of trousers, a bed pan, a waste container having an inlet and an outlet, and a noise reduction oven. The upper part is connected to the lower part via a hinge. A first lifter is disposed on the upper part. A groove is disposed at the bottom of the negative pressure care bed and formed via the worktable and the armrest. The rocking bed is disposed on the groove via multiple bearing supports. The excretion holes are disposed on the mattress and on the lower bed surface of the rocking bed. The trousers are disposed on the excretion hole. The bed pan is disposed in the excretion hole and on the trousers.

13 Claims, 4 Drawing Sheets

NEGATIVE PRESSURE CARE BED

CROSS-REFERENCE TO RELATED APPLICATIONS

This application is a continuation of International Patent Application No. PCT/CN2008/001151 with an international filing date of Jun. 16, 2008, designating the United States, now pending, and further claims priority benefits to Chinese Patent Application No. 200810083912.4 filed on Mar. 10, 2008. The contents of all of the aforementioned applications, including any intervening amendments thereto, are incorporated herein by reference.

BACKGROUND OF THE INVENTION

1. Field of the Invention

The invention relates to a bed, and more particularly to a negative pressure care bed.

2. Description of the Related Art

Care beds are now widely used by bedfast patients such as paralytics and semi-paralytics. However, there are several problems with the existing care beds: first, due to limitation of structure thereof, indoor defecation may cause strange smell that is difficult to be eliminated, which affects living environment, does harm to patients' health, and brings great inconvenience to nurses; second, turn-over of patients causes bodies thereof to deviate from defecation holes, and thus cushions are easily to be polluted, which brings great convenience for nursing; third, cushions used by bedfast patients are normally very humid, which often causes the patients to get bedsore; fourth, as bedding articles such as cushions are to be changed, nurses need to move the patients, which is tedious and labor consuming, and thus increasing nursing difficulty and inconvenience; fifth, unconscious defecation of paralytics pollutes bed sheets and bodies thereof; sixth, long-term sleeping thereof causes wet lung; and last, disturbance of blood circulation occurs at small arteries and capillary vessels of body parts under negative pressure.

SUMMARY OF THE INVENTION

In view of the above-described problem, it is one objective of the invention to provide a negative pressure care bed capable of addressing above-mentioned problems.

To achieve the above objectives, in accordance with one embodiment of the invention, provided is a negative pressure care bed, comprising a worktable, an armrest, a rocking bed having an upper bed surface and a lower bed surface, a mattress, a body comprising an upper part and a lower part, multiple excretion holes, a pair of trousers, a bed pan, a waste container having an inlet and an outlet, and a noise reduction oven. The upper part is connected to the lower part via a hinge, a first lifter is disposed on the upper part, a groove is disposed at the bottom of the negative pressure care bed and formed via the worktable and the armrest, the rocking bed is disposed on the groove via multiple bearing supports, the excretion holes are disposed on the mattress and on the lower bed surface of the rocking bed, the trousers are disposed on the excretion hole, the bed pan is disposed in the excretion hole and on the trousers, a negative pressure valve is disposed at the top of the bed pan, the bottom of the bed pan is connected to the inlet of the waste container, a first hollow pump is disposed in the noise reduction oven, and the outlet of the waste container is sequentially connected to a carbon fiber filter, a steam-water separator, and an inlet of the first hollow pump.

In a class of this embodiment, it further comprises a cleaning device comprising a water container, and a first water-supply pipe and a second water-supply pipe with different diameters In a class of this embodiment, one end of the pipe is received in the water container, and the other end thereof is connected to the bed pan via a tee.

In a class of this embodiment, a seal channel is disposed in the mattress, multiple negative pressure suction inlets are connected to the top of the seal channel and disposed at a back and a hip of a patent sleeping on the negative pressure care bed, an air cut valve is connected to the bottom of the seal channel via an interface, and the number of the negative pressure suction inlets is at least four.

In a class of this embodiment, a second hollow pump is disposed in the noise reduction oven, and the air cut valve is connected to the second hollow pump via a negative pressure cylinder.

In a class of this embodiment, a second lifter and a stop sensor are disposed on the lower bed surface of the rocking bed, the upper bed surface and the lower bed surface are lower than a plane formed by the worktable and the armrest, and the upper bed surface is connected to the lower bed surface via a connector.

In a class of this embodiment, a deodorizing device operating to receive deodorant is disposed at the inlet of the waste container, and a water level alarm is disposed at the outlet of the waste container.

In a class of this embodiment, a flow guide groove is disposed on inner wall of the bed pan, the bottom of the bed pan is in the shape of a bag, and a cribriform filter screen is disposed at the bottom of the bed pan.

In a class of this embodiment, it further comprises a blowing device comprising an air heating and dehumidifying device and a warm-air pipe.

In a class of this embodiment, an outlet of the warm-air pipe is connected to an inlet of the bed pan.

In a class of this embodiment, the trousers are fixed on the excretion hole via a fixing belt.

In a class of this embodiment, an ultraviolet light source, a photocatalyst filter screen, and a carbon fiber filter screen are disposed at the outlet of the noise reduction oven.

In a class of this embodiment, a cushion is fixed on the mattress via a fixing part, a bed sheet is fixed on the cushion, and the mattress, the cushion, and the bed sheet are divided into the upper bed surface and the lower bed surface.

ADVANTAGES OF THE INVENTION COMPRISE 1. the bed pan disposed on the trousers and in the excretion hole, the negative pressure valve disposed at the top of the bed pan, the sealing channel, the cleaning device, and the blowing device facilitate a closed defecation system, and the bed pan is tightly attached to skin of a lower part of a patient under negative pressure, whereby forming a sealed leakproof device with a variable shape that is capable of preventing leakage of defecation and keeping clean of bed surface.

2. the negative pressure valve enables small amount of air to enter the bed pan, whereby keeping inside of the bed pan ventilated, dry and cool, and protecting skin of the patient in the bed pan.

3. once a water resource is connected, skin of the patient in the bed pan can be automatically washed and residual pollution can be cleaned, and thus nurses do not need to clean defecation and a lower part of the patient. After a pipe of the bed pan is replaced by a blowing device, skin of the lower part of the patient can be dried via hot wind, which greatly reduces work difficulty and work strength of the nurses.

4. air in the container is discharged from the noise reduction oven after chemical deodorization, filtering via carbon fiber, ultraviolet disinfection, photocatalytic sterilization, and re-filtering via the carbon fiber, and thus air in a ward is clean, and the ward is quiet.

5. the seal channel is disposed in the mattress, the top of the seal channel is connected to the negative pressure suction inlet, the bottom thereof is connected to the second hollow pump in the noise reduction oven via the air cut valve and the negative pressure cylinder whereby forming a negative pressure structure. Negative airflow from the second hollow pump passes through the cushion under the patient, and absorbs sweat, humid gas and heat from the negative pressure suction inlet of the mattress, which ensures drying and cleaning of the bed surface, eliminates humidity and burning heat sensation of the patient, and prevents bedsore.

6. the bed surface of the rocking bed is lower than a plane formed by the worktable and the armrest, whereby forming a cradle-type bed having a width the same as that of a shoulder of the patient, and the swinging bed surface enables the patient to change compressing force at a contact position between the body and the bed surface without moving.

7. the arms of the patient put on the worktable and the armrest, and contact between one side of the body and groove wall during swinging bear partial pressure, and enable patients incapable of turning over to have an ever-changed, stable and comfortable prone position, to turn over without moving, and to have his/her hip to accurately rest on the excretion hole, whereby eliminating great pain of being unable to move his/her body due to pathogenesis or treating requirement.

8. since a rotating axis of the hinge connecting the upper part and the lower part is higher than the bed surface, and the cushion and the bed sheet are fixed on the mattress and the bed surface, ascending of the upper part along the rotating axis of the hinge causes the hip curve of the patient to change whereby generating frictional resistance with respect to the lower bed surface that tightly pushes the hip and the back of the patient on the soft upper bed surface without moving downwards. Thus a patient incapable of sitting before can sit and maintain a straight, nature and stable sitting posture without assistance from others.

9. the invention features reasonable space utilization, the worktable greatly reduces physical labor and working difficulty during nursing, and the mattress, the cushion, and the bed sheet bring great convenience for nurses making the bed.

Figure 1:
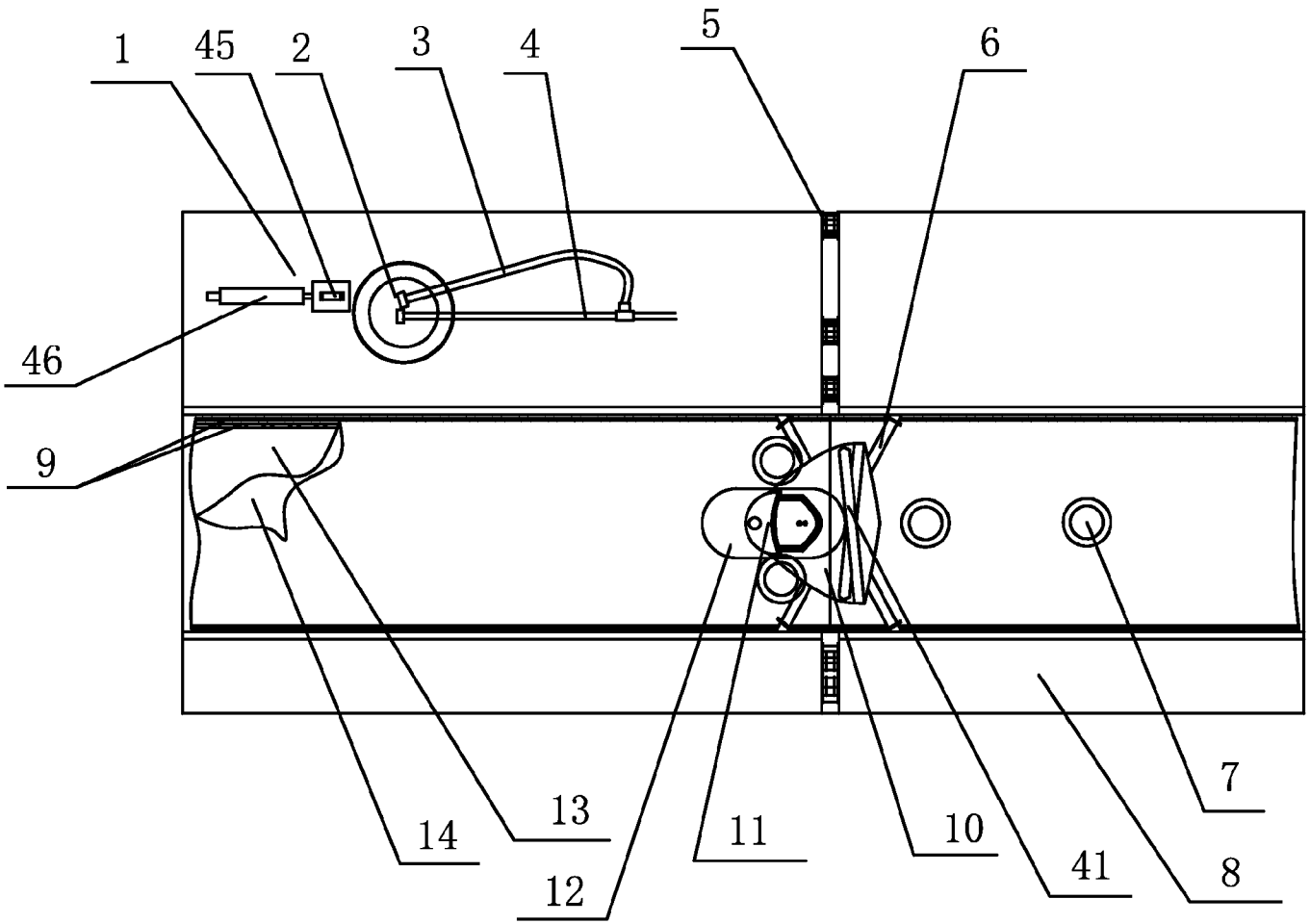
FIG. 1 is a top view of a negative pressure care bed of an exemplary embodiment of the invention.

In the drawings, the following reference numbers are used: 1—worktable, 2—water container, 3—first water-supply pipe, 4—second water-supply pipe, 5—hinge, 6—fixing belt, 7—negative pressure suction inlet, 8—armrest, 9—fixing part, 10—trousers, 11—bed pan, 12—excretion hole, 13—cushion, 14—bed sheet, 15—cribriform filter screen, 16—connector, 17—upper part, 18—negative pressure cylinder, 19—first lifter, 20—noise reduction oven, 21—steam-water separator, 22—carbon fiber filter, 23—waste container, 24—water level alarm, 25—deodorizing device, 26—second lifter, 27—lower part, 28—bedstead, 29—air cut valve, 30—seal channel, 31—bearing support, 32—mattress, 33—interface, 34—first hollow pump, 35—second hollow pump, 36—ultraviolet light source, 37—photocatalyst filter screen, 38—carbon fiber filter screen, 39—rocking bed, 40—negative pressure valve, 41—girdle, 42—stop sensor, 43—silencer cotton, 44—control box, 45—air heating and dehumidifying device, 46—warm-air pipe.

DETAILED DESCRIPTION OF THE EMBODIMENTS

Detailed description will be given below in conjunction with accompanying drawings.

Figure 3:
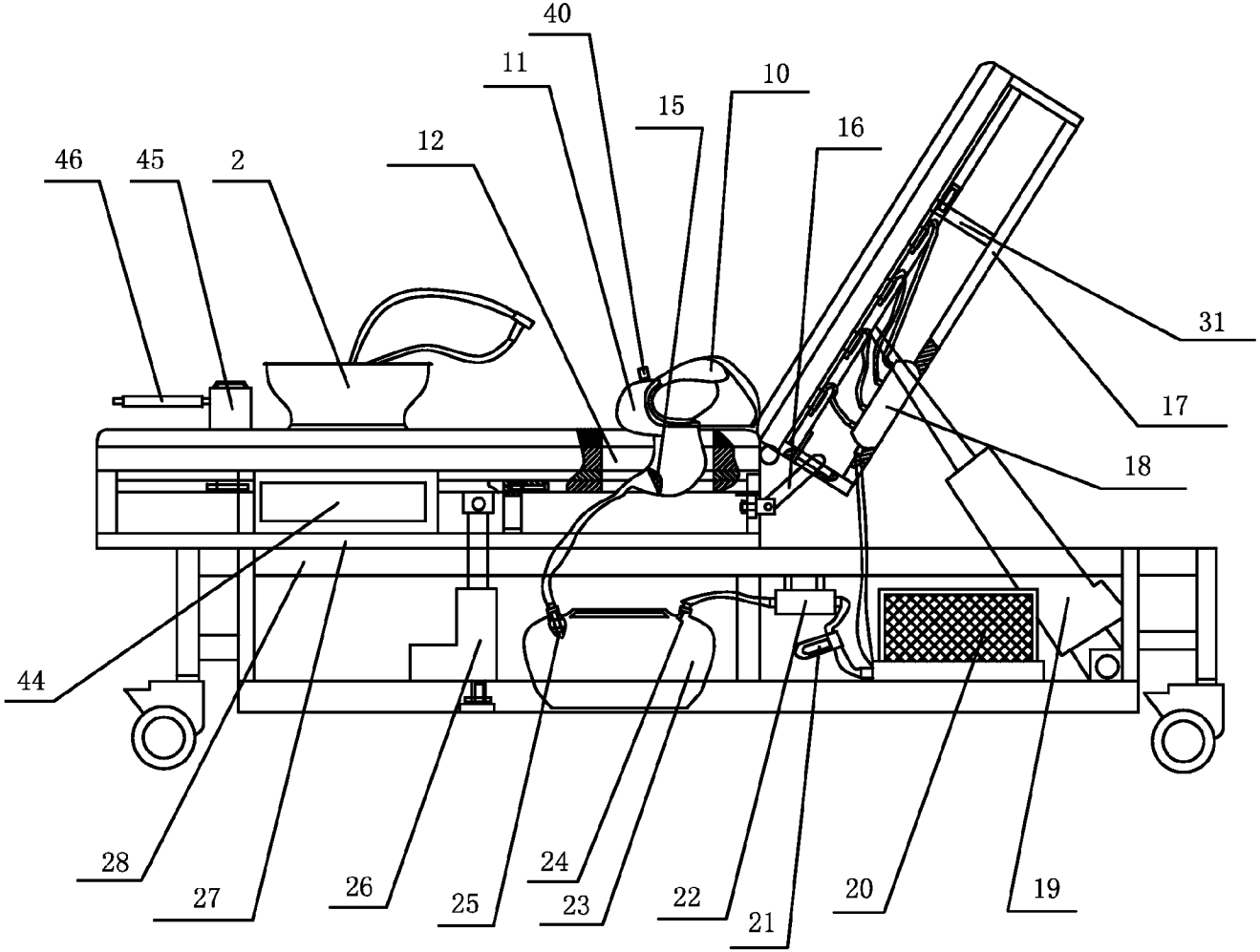
FIG. 3 is a front view of a negative pressure care bed of an exemplary embodiment of the invention.
Figure 4:
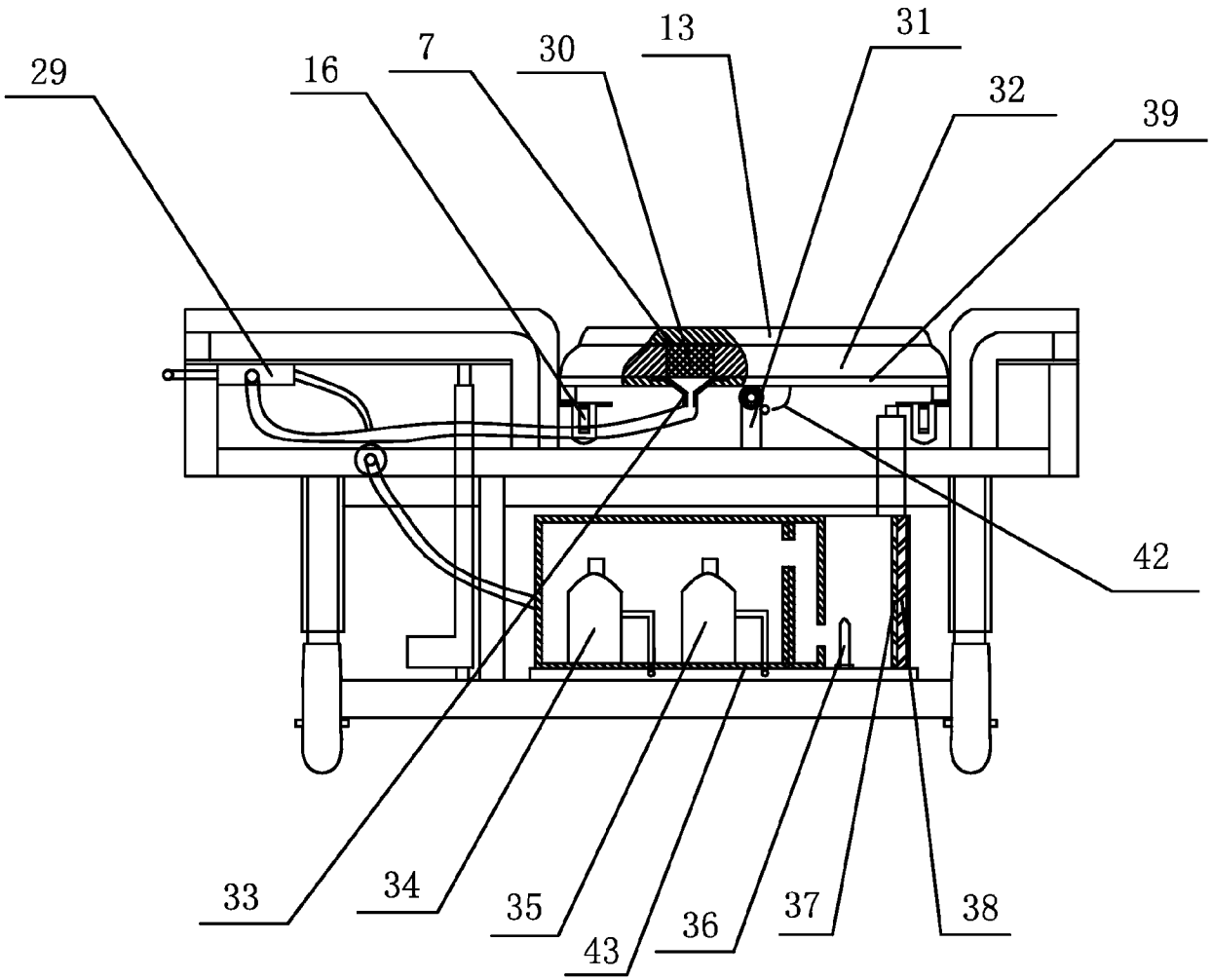
FIG. 4 is a side view of a negative pressure care bed of an exemplary embodiment of the invention.

As shown in FIG. 1, FIG. 3 and FIG. 4, a negative pressure care bed of the invention comprises a worktable 1, an armrest 8, a rocking bed 39 having an upper bed surface and a lower bed surface, a mattress 32, a body comprising an upper part 17 and a lower part 27, an excretion hole 12, a pair of trousers 10, a bed pan 11, a waste container 23 having an inlet and an outlet, and a noise reduction oven 20. The upper part 17 is connected to the lower part 27 via a hinge 5. A first lifter 19 is disposed on the upper part 17. A groove is disposed at the bottom of the negative pressure care bed and formed via the worktable 1 and the armrest 8. The rocking bed 39 is disposed on the groove via multiple bearing supports 31.

The excretion hole 12 is disposed on the mattress 32, on the lower bed surface of the rocking bed 39, and on a central line of a hip of a patient sleeping on the bed.

The trousers 10 are disposed on the excretion hole 12, and the bed pan 11 is disposed in the excretion hole 12 and on the trousers 10.

A negative pressure valve 40 is disposed at the top of the bed pan 11, and the bottom of the bed pan 11 is connected to the inlet of the waste container 23.

A first hollow pump 34 is disposed in the noise reduction oven 20, and the outlet of the waste container 23 is sequentially connected to a carbon fiber filter 22, a steam-water separator 21, and an inlet of the first hollow pump 34.

Preferably, the number of the bearing supports 31 is four, and two bearing supports 31 are disposed on each of the upper part and the lower part.

On a same axis, the first lifter 19 is connected to a bedstead 28 and drives the upper part 17 to ascend in a curve, and an ascending angle is no greater than 75°.

A deodorizing device 25 operating to receive deodorant is disposed at the inlet of the waste container 23, and a water level alarm 24 is disposed at the outlet of the waste container 23. The deodorant is chemical deodorant, and waste and water deposit at the bottom of the waste container 23.

To eliminate noise generated by the first hollow pump 34, the first hollow pump 34 is disposed in the noise reduction oven 20, and silencer cotton 43 is used for absorbing noise and keeping a wad quiet.

An ultraviolet light source 36, a photocatalyst filter screen 37, and a carbon fiber filter screen 38 are disposed at the outlet of the noise reduction oven 20 for further deodorization, sterilization, and disinfection.

Figure 2:
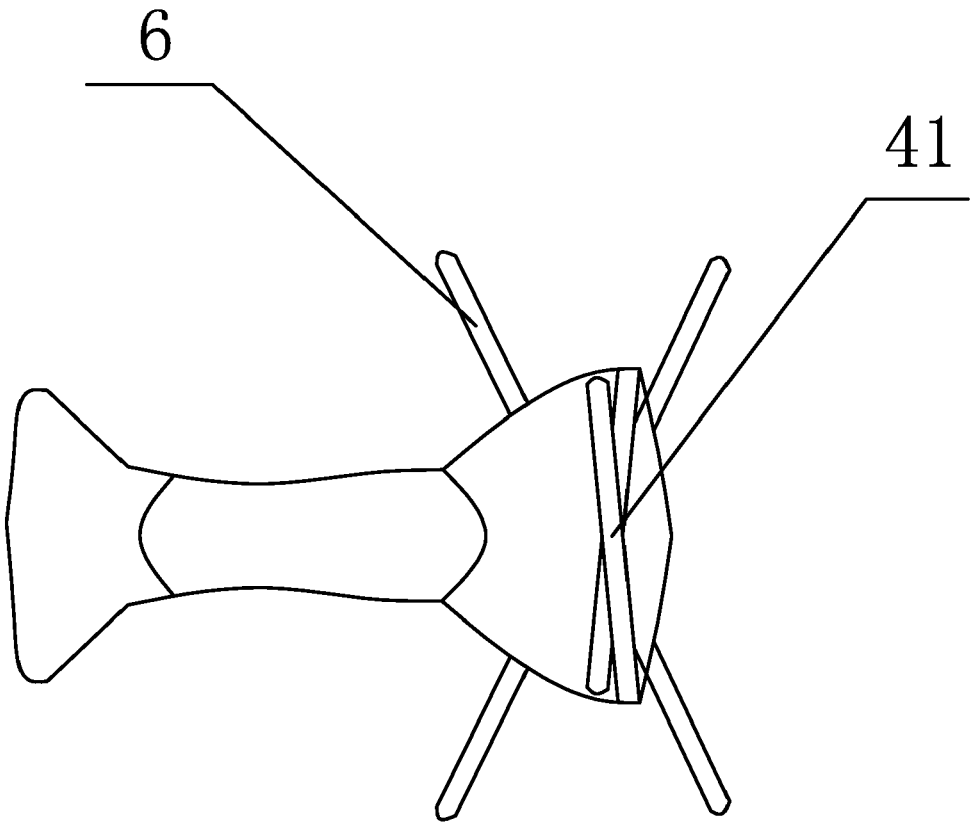
FIG. 2 is a schematic view of a pair of trousers of the invention.

As shown in FIGS. 1-3, the trousers 10 are fixed on the excretion hole 12 via a fixing belt 6 in a manner of adhesion, buckling, or sewing. The front of the trousers 10 bypasses a lower part of the patient and is connected to a girdle 41 at the back of the trousers 10 whereby fixing the trousers 10 on the patient's body. Alternatively, the bed pan 11 can be sewed at the center between the front and the back of the trousers 10.

The bed pan 11 is made of soft, waterproof, nonpoisonous, acid and alkali resisting materials with good elasticity, such as silica gel. The bed pan 11 should be big enough to cover excretory organs of the patient.

As shown in FIG. 3, the negative pressure valve 40 is disposed at the top of the bed pan 11. Constantly-increased negative pressure in the bed pan 11 presses a spring in the negative pressure valve 40 and opens a spherical piston. At this time, air entering therein automatically adjusts negative pressure of a sealing system in the bed pan 11, and thus keeping inside of the bed pan 11 ventilated.

As shown in FIG. 1, FIG. 3 and FIG. 4, the invention further comprises a cleaning device, comprising a water container 2, and a first water-supply pipe 3 and a second water-supply pipe 4 with different diameters. The first water-supply pipe 3 is a constant flow water-supply pipe, and the second water-supply pipe 4 is a negative pressure water-supply pipe.

One end of the pipe is received in the water container 2, and the other end thereof is connected to the bed pan 11 via a tee 11. As the lower part of the patient needs to be cleaned, the negative pressure valve 40 on the bed pan 11 is removed, and the tee is connected to the bed pan 11. The first water-supply pipe 3 is always open, and an inner diameter thereof is less than 5 mm. Since an inspiratory flow rate of the first hollow pump 34 is 10-30 cubic liters and greater than available water supply of the first water-supply pipe 3 under normal pressure, negative pressure exists in the bed pan 11 and makes the bed pan 11 contracted.

A flow guide groove is disposed on inner wall of the bed pan 11, inner wall of the contracted bed pan 11 is attached to skin of the patient. Water only flows between the flow guide groove and the skin and cleans waste on the skin.

As negative pressure of the bed span 11 keeps increasing, the second water-supply pipe 4 is opened. An inner diameter of the second water-supply pipe 4 is greater than 10 mm, and flow rate thereof is greater than an inspiratory flow rate of the first hollow pump 34 under normal pressure.

After lots of water enters the bed pan, the negative pressure disappears, and the bed pan 11 extends and recovers. By opening or closing the second water-supply pipe 4, the bed pan 11 is correspondingly opened or closed, and thus the lower part of the patient in the bed pan 11 is cleaned. The bottom of the bed pan 11 is in the shape of a bag and operates to receive excrement of the patient. An hole is disposed at the bottom of inner side of the bottom of the bed pan 11, and a cribriform filter screen 15 is disposed at the hole. The cribriform filter screen 15 allows urines and small excrements to pass and prevents large excrements from blocking the hole. Large excrements stopped by the cribriform filter screen 15 are left in the bottom of the bed pan 11, and are discharged via the hole after immersing in the urine and becoming soft.

As shown in FIG. 1 and FIG. 3, the invention further comprises a blowing device, comprising an air heating and dehumidifying device 45 and a warm-air pipe 46.

An outlet of the warm-air pipe 46 is connected to an inlet of the bed pan 11. During operation, the first water-supply pipe is removed first, then the outlet of the warm-air pipe 46 is connected to the inlet of the bed pan 11, an inspiratory flow rate of the first hollow pump 34 is increased to be greater than air input of the warm-air pipe 46 under normal pressure, finally warm air is induced via negative pressure whereby blowing and drying the skin of the patient in the bed pan 11.

As shown in FIG. 1, FIG. 3 and FIG. 4, a seal channel 30 is disposed in the mattress 32. Multiple negative pressure suction inlets 7 are connected to the top of the seal channel 32 and disposed on the left and the right of a hip and at the top and the bottom of back of the patent sleeping on the negative pressure care bed. An air cut valve 29 is connected to the bottom of the seal channel 32 via an interface 33. The air cut valve 29 is connected to the second hollow pump 35 in the noise reduction oven 20 via a negative pressure cylinder 18.

In this embodiment, the number of the negative pressure suction inlets 7 is at least four, and the negative pressure suction inlet 7 is made of breathable cloth.

A production method of the seal channel 30 is as follows: a hole is opened on waterproof fabrics of the mattress 32 first, then linings in the mattress 32 is taken out whereby forming a channel, wall of the channel is sealed via soft and non-breathable materials, the linings are filled in the channel, and finally a breathable negative pressure suction inlet 7 is sewed on the hole. Preferably the hole is circular.

As shown in FIG. 1, FIG. 3 and FIG. 4, a second lifter 26 and a stop sensor 42 are disposed on the lower bed surface of the rocking bed 39, the upper bed surface and the lower bed surface are lower than a plane formed by the worktable 1 and the armrest 8, and the upper bed surface is connected to the lower bed surface via a connector 16 whereby ensuring they are on the same plane or enabling the upper bed surface to ascend along with a body of the rocking bed 39. The bed surface is lower than the plane of the worktable 1, and the mattress 32 and the cushion 13 are disposed on the rocking bed via difference in height therebetween whereby forming a cradle-type bed. A control box 44 is connected to a manual and an automatic controller. The manual controller is capable of freely adjusting lateral position and sitting. The automatic controller is capable of setting a left lower (right upper) position, a supine position, a right lower (left upper) position as required, and a swing angle is less than ±15°.

The mattress 32 is disposed on the rocking bed 39, and made of waterproof leather or imitation leather, and uses elastic materials such as foams as packing. The cushion 13 is disposed on the mattress 32 via a fixing part 9, surface thereof is made of normal breathable fabrics, and a lining thereof is made of breathable and elastic materials with a thickness of approximately 2 cm. A bed sheet 14 is disposed on the cushion 13. The mattress 32, the cushion 13 and the bed sheet 14 are divided into an upper bed surface and a lower bed surface.

In this embodiment, the fixing part 9 is a zipper, a thread gluing, a button and so on.

The excretion hole 12 is disposed on each of the cushion 13 and the bed sheet 14.

Multiple soft and waterproof pads are disposed on both sides of the groove, and on a plane formed by the worktable 1 and the armrest 8 whereby protecting the body of the patient. In this embodiment, the soft and waterproof pad is made of leather or imitation leather, and the first water-supply pipe 3, the second water-supply pipe 4, and the warm-air pipe 46 are preferably soft pipes.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

The invention claimed is:

1. A negative pressure care bed, comprising a worktable;

an armrest;

a rocking bed having an upper bed surface and a lower bed surface;

a mattress;

a body comprising an upper part and a lower part;

multiple excretion holes;

a pair of trousers;

a bed pan;

a waste container having an inlet and an outlet; and a noise reduction oven;

wherein said upper part is connected to said lower part via a hinge;

a first lifter is disposed on said upper part;

a groove is disposed at the bottom of said negative pressure care bed and formed via said worktable and said armrest;

said rocking bed is disposed on said groove via multiple bearing supports;

said excretion holes are disposed on said mattress and on said lower bed surface of said rocking bed;

said trousers are disposed on said excretion hole;

said bed pan is disposed in said excretion hole and on said trousers;

a negative pressure valve is disposed at the top of said bed pan;

the bottom of said bed pan is connected to said inlet of said waste container;

a first hollow pump is disposed in said noise reduction oven; and said outlet of said waste container is sequentially connected to a carbon fiber filter, a steam-water separator, and an inlet of said first hollow pump.

2. The negative pressure care bed of claim 1, further comprising a cleaning device comprising a water container, and a first water-supply pipe and a second water-supply pipe with different diameters.

3. The negative pressure care bed of claim 2, wherein one end of said first water-supply pipe and one end of said second water-supply pipe are received in said water container, and the other end of said first water-supply pipe and the other end of said second water-supply pipe are connected to said bed pan via a tee.

4. The negative pressure care bed of claim 1, wherein a seal channel is disposed in said mattress;

multiple negative pressure suction inlets are connected to the top of said seal channel and disposed at a back and a hip of a patent sleeping on said negative pressure care bed;

an air cut valve is connected to the bottom of said seal channel via an interface; and the number of said negative pressure suction inlets is at least four.

5. The negative pressure care bed of claim 4, wherein a second hollow pump is disposed in said noise reduction oven; and said air cut valve is connected to said second hollow pump via a negative pressure cylinder.

6. The negative pressure care bed of claim 1, wherein a second lifter and a stop sensor are disposed on said lower bed surface of said rocking bed;

said upper bed surface and said lower bed surface are lower than a plane formed by said worktable and said armrest; and said upper bed surface is connected to said lower bed surface via a connector.

7. The negative pressure care bed of claim 1, wherein a deodorizing device operating to receive deodorant is disposed at said inlet of said waste container; and a water level alarm is disposed at said outlet of said waste container.

8. The negative pressure care bed of claim 1, wherein a flow guide groove is disposed on inner wall of said bed pan;

the bottom of said bed pan is in the shape of a bag; and a cribriform filter screen is disposed at the bottom of said bed pan.

9. The negative pressure care bed of claim 1, further comprising a blowing device comprising an air heating and dehumidifying device and a warm-air pipe.

10. The negative pressure care bed of claim 9, wherein an outlet of said warm-air pipe is connected to an inlet of said bed pan.

11. The negative pressure care bed of claim 1, wherein said trousers are fixed on said excretion hole via a fixing belt.

12. The negative pressure care bed of claim 1, wherein an ultraviolet light source, a photocatalyst filter screen, and a carbon fiber filter screen are disposed at said outlet of said noise reduction oven.

13. The negative pressure care bed of claim 1, wherein a cushion is fixed on said mattress via a fixing part;

a bed sheet is fixed on said cushion; and said mattress, said cushion, and said bed sheet are divided into said upper bed surface and said lower bed surface.

* * * * *